US005417412A

United States Patent [19]

Vegeais et al.

[11] Patent Number: 5,417,412

[45] Date of Patent: May 23, 1995

[54] DEVICE FOR SEPARATING SHEETS IN AN OFFICE MACHINE AND A METHOD FOR ADJUSTING THE STOP ON THIS DEVICE

[75] Inventors: Patrick Vegeais, Fourqueux; Eric Cavarero, Cergy, both of France

[73] Assignee: Societe d'Applications Generales d'Electricite et de Mecanique Sagem, France

[21] Appl. No.: 219,498

[22] Filed: Mar. 29, 1994

[30] Foreign Application Priority Data

Mar. 30, 1993 [FR] France ..... 93 03663

[51] Int. Cl.[6] ..... B65H 3/52

[52] U.S. Cl. ..... 271/124; 271/121

[58] Field of Search ..... 271/121, 124, 125

[56] References Cited

U.S. PATENT DOCUMENTS

| | | | |
|---|---|---|---|
| 2,214,752 | 9/1940 | Pierce et al. . | |
| 4,232,860 | 11/1980 | Brown | 271/125 |
| 4,313,598 | 2/1982 | DiBlasio . | |
| 4,603,848 | 8/1986 | Markgraf et al. | 271/125 |
| 5,143,365 | 9/1992 | Green | 271/121 |
| 5,163,668 | 11/1992 | Winship et al. | 271/124 |
| 5,193,798 | 3/1993 | Okano | 271/124 |

FOREIGN PATENT DOCUMENTS

| | | | |
|---|---|---|---|
| 0157343 | 9/1985 | European Pat. Off. . | |
| 1278210 | 9/1968 | Germany . | |
| 3061235 | 3/1991 | Japan | 271/121 |
| 3102037 | 4/1991 | Japan | 271/121 |

*Primary Examiner*—H. Grant Skaggs
*Attorney, Agent, or Firm*—Rosenman & Colin

[57] ABSTRACT

A device for separating a stack of sheets in an office machine such as a facsimile machine, comprising an extractor roller (18), a presser member (14) pressed resiliently in the direction of the roller, and a stop (5) limiting the maximum distance between the extractor roller and the presser member. The stop is mounted so as to slide inside a supporting part (1) in the direction of the presser member. A spring pushes the stop toward the presser member, and a locking collar (11, 12) limits its sliding distance. The presser member is mounted on the supporting part so as to provide an integral device, improving reliability and reducing assembly time.

7 Claims, 1 Drawing Sheet

DEVICE FOR SEPARATING SHEETS IN AN OFFICE MACHINE AND A METHOD FOR ADJUSTING THE STOP ON THIS DEVICE

BACKGROUND OF THE INVENTION

The present invention concerns a device for separating a stack of sheets in an office machine such as a facsimile machine, and more particularly such a device comprising an extractor roller, a presser member pressed resiliently in the direction of the roller, and a stop limiting the maximum distance between the extractor roller and the presser member, and a method for adjusting the stop on this device.

In an office machine with a loader for a stack of sheets and a drive device for conveying the sheets one by one, and notably in a facsimile machine, the sheets of paper to be processed may be introduced in stacks, at least two, in a loader, one above the other, against an extractor roller on the one hand and a retaining pad on the other. The rubber roller is designed to move these sheets one by one, those which are located above the extracted sheet being retained by the pad, also made of rubber. While it is being moved, beyond the roller, a sheet passes between rollers in a set of draw rollers which take it to its processing station.

In order to allow a sheet of paper to pass through, the pad must be able to move away from the extractor roller. The distance between them must however be limited in order to prevent several sheets from passing simultaneously between the roller and the pad. To this end, provision is made, in a known manner, for the pad to be pressed in the direction of the extractor roller by means of a presser member pushed by resilient means, and for the movement of this presser member to be limited by means of a stop.

This stop has the drawback of requiring very delicate adjustment, both during the assembly of the machine and during maintenance operations.

SUMMARY OF THE INVENTION

The aim of the present invention is to mitigate these drawbacks.

To this end, the invention concerns, first of all, a device for separating sheets in a stack in an office machine such as a facsimile machine, comprising an extractor roller, a presser member pressed resiliently in the direction of the roller, and a stop limiting the maximum distance between the extractor roller and the presser member, characterised in that the stop is mounted so as to slide relative to a supporting part in the direction of the presser member, resilient means being provided to push the said stop in this direction, and locking means being provided to limit its sliding.

In a particular embodiment, the stop is substantially cylindrical and the resilient means comprise a helical spring bearing on the one side on the supporting part and on the other side on a shoulder on the stop.

The locking means may notably comprise a collar gripping of said stop.

Advantageously, the presser member is itself mounted so as to slide relative to the supporting part.

This presser member may more particularly comprise two lateral projections, each engaged in a groove in the supporting part.

The supporting part may in particular comprise means for snapping onto the frame of the said office machine.

The present invention also concerns a method for adjusting the stop on the device described above, comprising the steps of:

- locking the stop relative to the supporting part using locking means, in a position which is at a distance from its operating position;
- mounting the supporting part on the frame of the office machine with the stop opposite the presser member and extractor roller;
- placing a shim with a calibrated thickness between the presser member and the extractor roller;
- loosening and then retightening the locking means.

The device according to the invention thus reduces the adjustment of the stop to a minimum number of operations.

Once the different components have been mounted on the frame of the machine, it is in fact sufficient to place, between the presser member and the extractor roller of the machine, the calibrated shim, the thickness of which is equal to the desired clearance for the presser member. The locking means are then loosened, thus freeing the stop which, under the action of the resilient means, comes into contact with the presser member and presses the latter against the shim, which is itself in contact with the extractor roller.

If the locking means are then retightened, the stop is locked in the correct position and the calibrated shim can then be withdrawn.

The adjustment operation therefore consists only of positioning the calibrated shim and loosening and then retightening the means of locking the stop.

The accuracy of the adjustment of the stop is the accuracy of the thickness of the shim. It is therefore possible to improve the operation of the device for separating sheets.

The invention also makes it possible to save time during assembly of the office machine containing the device.

Furthermore, when the presser member is itself mounted on the supporting part, an integral device is obtained, which permits the number of parts, the cost of the sheet-separation function and the assembly time to be reduced. The cost of maintenance is also reduced because of the ease of replacing the device, and reliability is increased.

BRIEF DESCRIPTION OF THE DRAWINGS

A particular embodiment of a invention will now be described, by way of non-limiting example, with reference to the accompanying drawings in which.

DETAILED DESCRIPTION OF A PREFERRED EMBODIMENT

Figure 1:
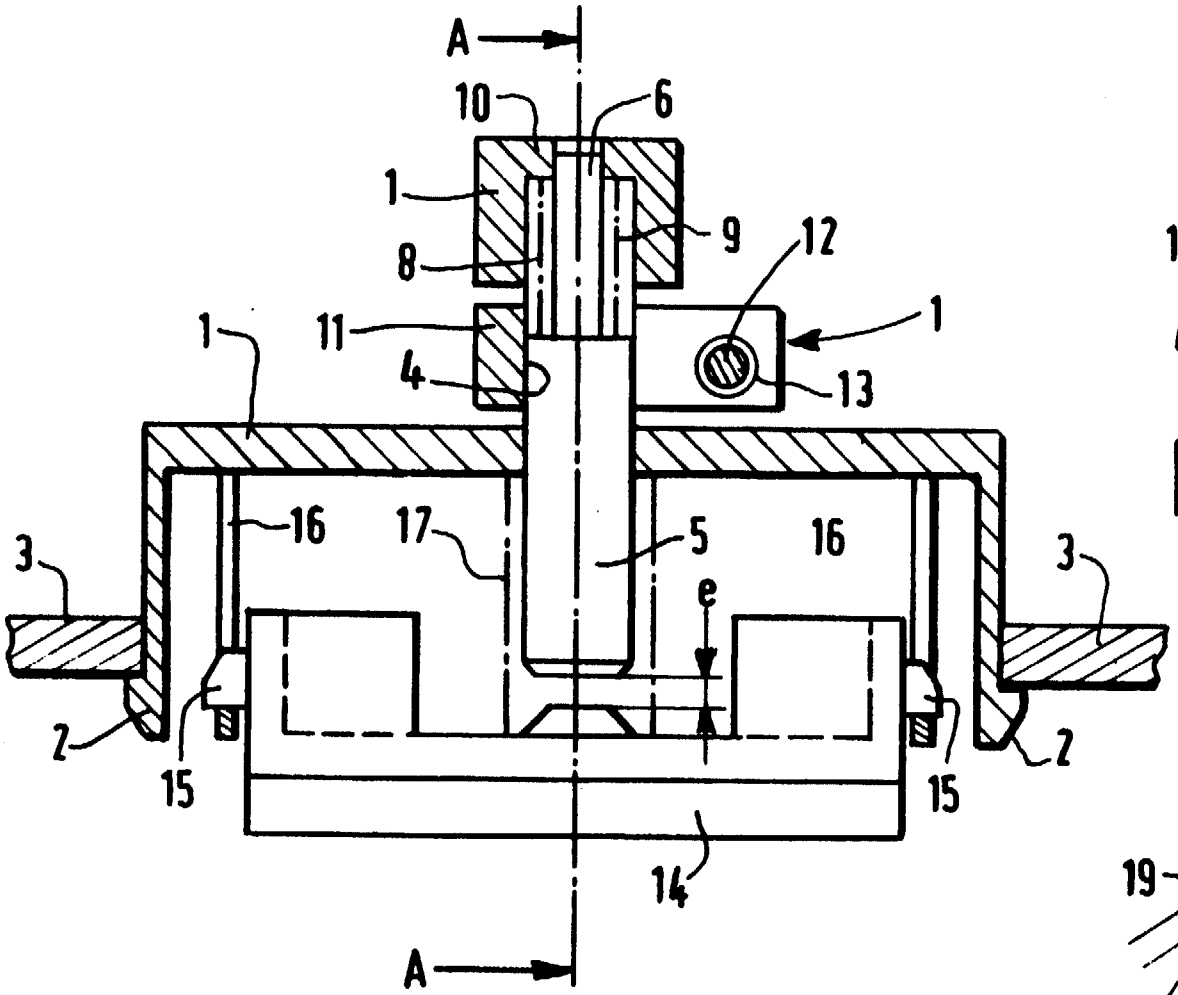
FIG. 1 is a cross section view of the device according to the invention, with its stop in the operating position.

The device shown in FIG. 1 comprises a supporting part 1, provided with lugs 2 for snapping onto the frame 3 of an office machine such as a facsimile machine.

The supporting part 1 forms a tubular housing 4 inside which is disposed a cylindrical stop 5. The stop 5 has an end section 6 with a smaller diameter forming a shoulder 7 and defining with the tubular housing 1 an annular space 8 in which is disposed a helical spring 9 bearing on the one hand on the shoulder 7 and on the other hand on an end wall 10 of the housing 4, the end section 6 of the stop 5 passing through this wall 10.

A collar 11, limited with the supporting part 1, enables the stop 5 to be locked in its housing 4 with respect to translational movement. To this end, the collar 11 grips the circumference of the stop 5 and its distal end is clamped by means of a screw 12 engaged in a hole 13 in the part 1.

The device according to the invention further comprises a presser member 14 with a V-shaped cross section, that is also mounted so as to slide in the supporting part 1.

To this end, the presser member 14 comprises two lateral projections 15 each engaged between the two limbs 16 of a hairpin-shaped part fixed to the supporting part 1, the two limbs 16 of each hairpin defining between them a sliding groove for the corresponding projection 15.

A helical spring 17 disposed around the 5 bears on the one hand on the supporting part 1 and on the other hand on the presser member 14, which it pushes in the direction of a sheet-extraction roller 18 mounted on the frame 3.

The presser member 14 therefore slides between two stop positions, one at a distance from the roller 18, in which it bears on the stop 5 and the other near the roller 18, in which it bears on the hairpin-shaped parts.

Figure 2:
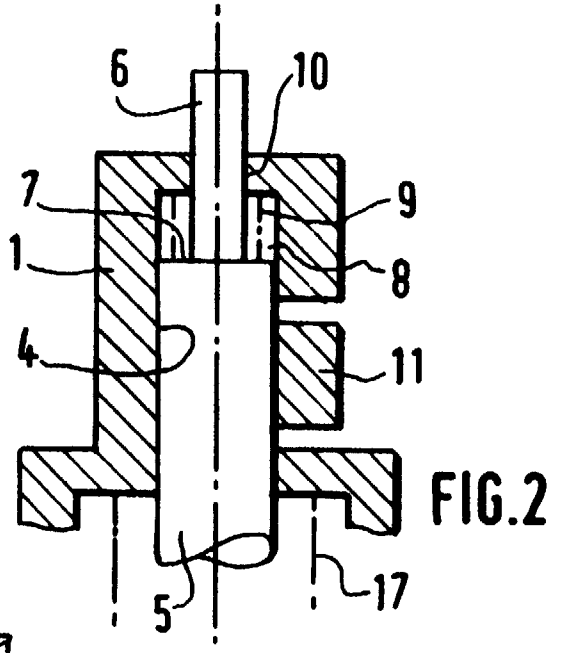
FIG. 2 is a view in partial cross section along the line A—A with the stop in the stand-by position.
Figure 3:
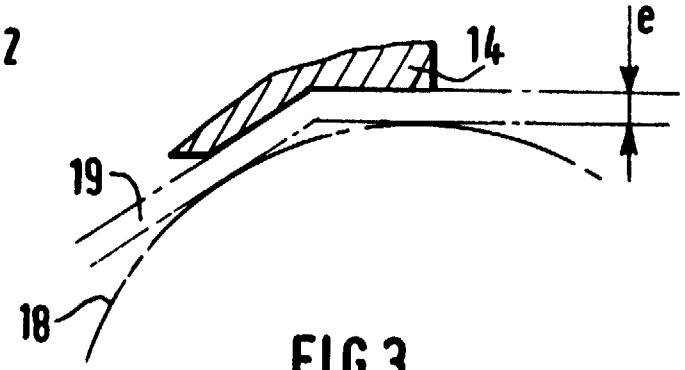
FIG. 3 is a view, also in partial cross section along the line A—A, illustrating the method of adjusting the stop.

When the device according to the invention is being assembled, the presser member 14 and the spring 17 are fitted in the supporting part as well as the spring 9 and the stop 5. The latter is brought into its position shown in FIG. 2, with the spring 9 compressed, a position in which it is held in place by tightening the screw 12.

The assembly thus configured is snapped onto the frame 3 of the machine, with the presser member 14 facing the extractor roller 18.

A shim 19, with a thickness "e" equal to the clearance which it is desired to obtain for the presser member 14, is then disposed between this presser member and the extractor roller 18. The assembly is maintained in this position by the spring 17, which pushes the presser member 14 against the calibrated shim 19, which itself bears on the roller 18.

The stop 5 is adjusted by loosening the screw 12, which has the effect of releasing the locking of the stop 5 by the collar 11. The stop 5 is then brought by the spring 9 to bear on the presser member 14. The screw 12 is then tightened again to hold the stop 5 in the position thus obtained and the calibrated shim 19 may be withdrawn, the spring 17 then bringing the presser member 14 to bear against the roller 18, the member 14 thus having in this position a possible clearance equal to "e".

We claim:

1. A device for separating a stack of sheets in an office machine, such as a facsimile machine, having an extractor roller, said device comprising:
   - a supporting part adapted to be mounted on the office machine;
   - a presser member mounted on said supporting part and pressed resiliently toward the extractor roller;
   - a stop adapted to limit the maximum distance between the extractor roller and the presser member, said stop being mounted so as to slide relative to said supporting part in the direction of the presser member;
   - resilient means for urging said stop toward said presser member; and
   - locking means for cooperating with said stop and said supporting part to limit said sliding.

2. The device according to claim 1, in which the stop is substantially cylindrical and the resilient means comprise a helical spring bearing on the supporting part on one side and on a shoulder on the stop on the other side.

3. The device according to claim 1, in which the locking means comprise a collar gripping said stop.

4. The device according to claim 1, in which the presser member is mounted so as to slide relative to the supporting part.

5. The device according to claim 4, in which the presser member has two lateral projections, each engaging a groove in the supporting part.

6. The device according to claim 1, in which the supporting part comprises means for snapping onto the frame of said office machine.

7. A method for adjusting the stop on a device for separating a stack of sheets in an office machine, such as a facsimile machine, having an extractor roller, said method comprising the steps of:
   - locking the stop relative to the supporting part in a position that is distant from its operating position;
   - mounting the supporting part on the frame of the office machine with the stop on the opposite side of the presser member from the extractor roller;
   - placing a shim having a calibrated thickness between the presser member and the extractor roller;
   - slackening and then retightening the locking means so as to set the operating position of the stop so that said thickness is the maximum gap permitted by the stop between the presser member and the extractor roller.

* * * * *